US008474118B2

(12) United States Patent
Hondo

(10) Patent No.: US 8,474,118 B2
(45) Date of Patent: Jul. 2, 2013

(54) INSERTION TOOL FOR TANGLESS SPIRAL COIL INSERT

(75) Inventor: Fusahide Hondo, Tokyo (JP)

(73) Assignee: Nippon Sprew Co., Ltd., Tokyo (JP)

( * ) Notice: Subject to any disclaimer, the term of this patent is extended or adjusted under 35 U.S.C. 154(b) by 0 days.

(21) Appl. No.: 13/386,987

(22) PCT Filed: Jul. 22, 2011

(86) PCT No.: PCT/JP2011/067377
§ 371 (c)(1),
(2), (4) Date: Jan. 25, 2012

(87) PCT Pub. No.: WO2012/015018
PCT Pub. Date: Feb. 2, 2012

(65) Prior Publication Data

US 2012/0272491 A1 Nov. 1, 2012

(30) Foreign Application Priority Data

Jul. 30, 2010 (JP) ..... 2010-172804

(51) Int. Cl.
*B25B 27/14* (2006.01)

(52) U.S. Cl.
USPC ..... 29/240.5; 29/243.5

(58) Field of Classification Search
USPC ..... 29/240.5, 243.5, 283.5; 81/440–445, 81/448, 459
See application file for complete search history.

(56) References Cited

U.S. PATENT DOCUMENTS

| | | | | |
|---|---|---|---|---|
| 4,172,314 | A * | 10/1979 | Berecz et al. | 29/240.5 |
| 5,212,865 | A | 5/1993 | Davis et al. | |
| 5,456,145 | A * | 10/1995 | Cosenza | 81/448 |
| 6,000,114 | A * | 12/1999 | Newton et al. | 29/240.5 |
| 6,367,138 | B1 | 4/2002 | Newton et al. | |
| 7,634,844 | B2 * | 12/2009 | Szewc et al. | 29/240.5 |
| 2007/0245533 | A1 * | 10/2007 | Szewc et al. | 29/240.5 |
| 2009/0293248 | A1 * | 12/2009 | Sato | 29/240.5 |
| 2010/0325857 | A1 * | 12/2010 | Szewc et al. | 29/240.5 |
| 2012/0272491 | A1 * | 11/2012 | Hondo | 29/240.5 |

FOREIGN PATENT DOCUMENTS

| | | | |
|---|---|---|---|
| EP | 0153268 | A2 | 8/1985 |
| JP | 60-191774 | A | 9/1985 |

(Continued)

OTHER PUBLICATIONS

Int'l Search Report issued Oct. 11, 2011 in Int'l Application No. PCT/JP2011/067377; Written Opinion.

*Primary Examiner* — Lee D Wilson
(74) *Attorney, Agent, or Firm* — Panitch Schwarze Belisario & Nadel LLP

(57) ABSTRACT

To provide an insertion tool for a tangless spiral coil insert that is simple in structure and is also easy to manufacture and assemble, as compared with a conventional tool, accordingly that allows reduction in manufacturing cost, and besides that is excellent in operability.

An insertion tool 1 for a tangless spiral coil insert includes, for inserting a tangless spiral coil insert 100 into a work, a mandrel 43 at least a leading end section of which is a screw shaft 45, and a pivotal claw 80 provided with a claw section 81 which engages with a notch 101 of an end coil section of the tangless spiral coil insert 100 screwed with the screw shaft 45. The pivotal claw 80 has an elastic connection member 83 one end of which is fixed to a pivotal-claw attachment groove 71, and the other end of which is attached to the claw section 81, and the elastic connection member 83 biases the claw section 81 outside in a radial direction of the screw shaft 45, so that a hook section 90 formed in the claw section 81 elastically engages with the notch 101 of the tangless spiral coil insert 100.

4 Claims, 12 Drawing Sheets

FOREIGN PATENT DOCUMENTS

| | | | |
|---|---|---|---|
| JP | 06-134679 | A | 5/1994 |
| JP | 11-333751 | A | 12/1999 |
| JP | 2001-113473 | A | 4/2001 |
| JP | 3091519 | U | 2/2003 |
| JP | 3849720 | B2 | 11/2006 |
| JP | 2006-346812 | A | 12/2006 |
| JP | 2007-283483 | A | 11/2007 |

* cited by examiner

FIG. 1(a)
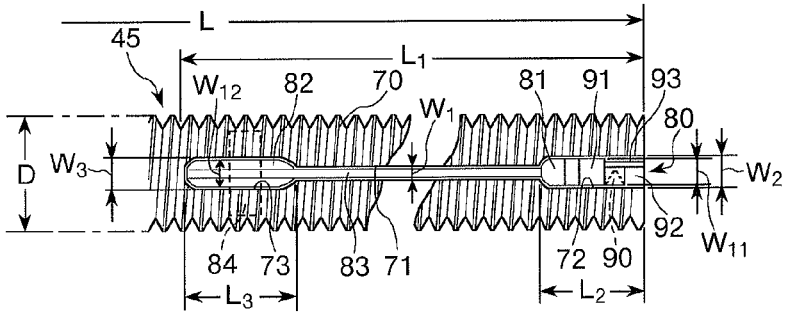
FIG. 1(b)
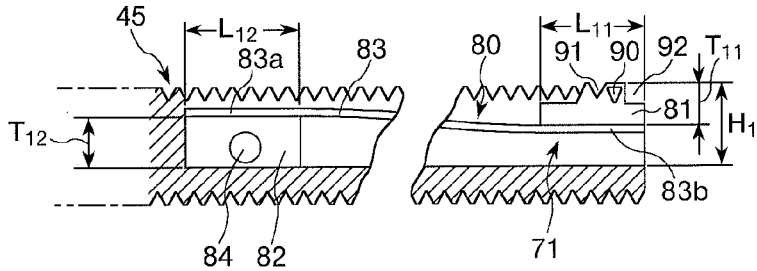
FIG. 1(c)
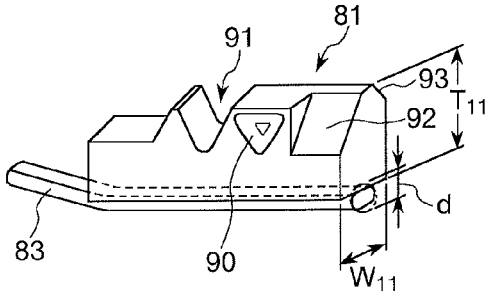
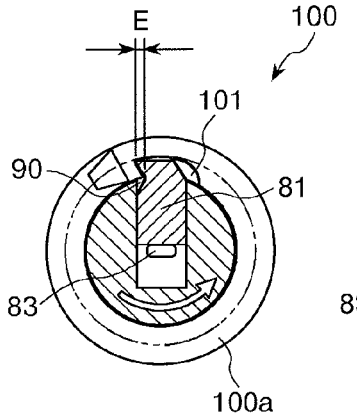
FIG. 1(d)
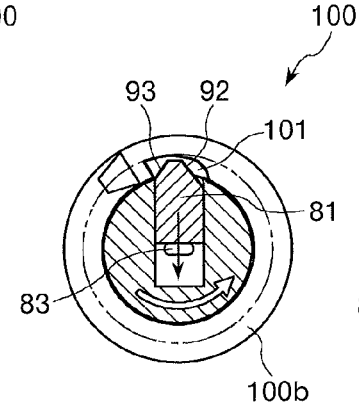
FIG. 1(e)
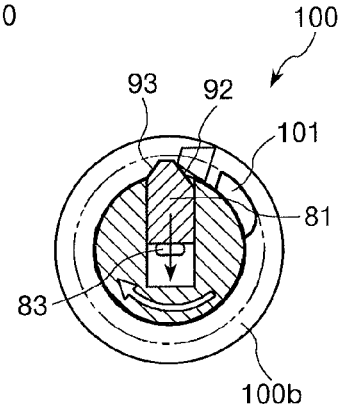
FIG. 1(f)

INSERTION TOOL FOR TANGLESS SPIRAL COIL INSERT

CROSS-REFERENCE TO RELATED APPLICATION

This application is a Section 371 of International Application No. PCT/JP2011/067377, filed Jul. 22, 2011, which has not yet been published, the disclosure of which is incorporated herein by reference.

TECHNICAL FIELD

The present invention relates to an insertion tool for a tangless spiral coil insert to attach a tangless spiral coil insert to a taphole of a work.

BACKGROUND ART

When a weak female screw makes it impossible to obtain a high tightening force while directly tapping into a work comprising a light metal such as aluminum, plastics, or cast iron, it is the conventional practice to use a spiral coil insert for the purpose of compensate for a high reliable screw tightening.

There are a tanged spiral coil insert and a tangless spiral coil insert as a spiral coil insert, but the tanged spiral coil insert requires an operation of removing a tang, after being attached to a work, and further an operation of collecting the tang removed. Therefore, the tangless spiral coil insert, which does not require such operations, is occasionally used.

A patent literature 1 discloses an attachment tool for such a tangless spiral coil insert. This will be described below with reference to FIGS. 10 to 12 appended to the present patent application.

An attachment tool 300 is provided with a tubular member 301, and a mandrel assembly 302 supported by the tubular member 301. A pivotal claw 303 is disposed in a hollow 304 formed in a longitudinal direction of the mandrel assembly 302, and the pivotal claw 303 is provided with a hook section 305 engaging with a notch 101 (FIG. 12) of a tangless spiral coil insert 100 at one leading end thereof.

In this example, the pivotal claw 303 is biased about a pivotal shaft 307 by a spring 306, and, the pivotal claw 303 is configured to pivot on the pivotal shaft 307 so that the hook section 305 sinks into the notch 101 of the coil insert 100 when the mandrel assembly 302 moves in a direction of an arrow 308 and the other end 309 of the pivotal claw 303 has entered a hole formed in the mandrel assembly 302.

PRIOR ART DOCUMENT

Patent Literature

[Patent Literature 1]
Publication of Japanese Patent No. 3849720

SUMMARY OF THE INVENTION

Problems to be solved by the Invention

The attachment tool 300 for a tangless spiral coil insert described in the patent literature 1 is excellent in operability, but in particular the mandrel assembly 302 provided with the pivotal claw 303 is complex in structure, and is difficult to manufacture or assemble, and accordingly results in a factor in high manufacturing cost.

Therefore, an object of the present invention is to provide an insertion tool for a tangless spiral coil insert that is simple in structure and is also easy to manufacture and assemble as compared with a conventional tool, accordingly that allows reduction in manufacturing cost and besides that is excellent in operability.

Means for solving the Problems

The above object is achieved by an insertion tool for a tangless spiral coil insert according to the present invention. In summary, the present invention is an insertion tool for a tangless spiral coil insert comprising, for inserting the tangless spiral coil insert into a work, a mandrel at least a leading end section of which is constituted as a screw shaft and a pivotal claw provided with a claw section which engages with a notch of an end coil section of the tangless spiral coil insert screwed with the screw shaft, wherein a pivotal-claw attachment groove is formed in the mandrel over a predetermined length in an axial direction of the mandrel in order to install the pivotal claw;

the pivotal claw has an elastic connection member one end of which is attached to the pivotal-claw attachment groove, and the other end of which is attached to the claw section; and the elastic connection member biases the claw section outward in a radial direction of the screw shaft such that a hook section formed on the claw section elastically engages with the notch of the tangless spiral coil insert.

According to an aspect of the present invention, the elastic connection member is a wire body having elasticity.

According to another aspect of the present invention, the insertion tool for a tangless spiral coil insert comprises a regulation member that regulates an amount of movement of the claw section biased by the elastic connection member of outward movement in a radially outward direction of the screw shaft. According to another aspect, the regulation member is a stopper ring, and is attached on an outer periphery of the screw shaft adjacent to the hook section of the claw section.

Effects of the Invention

According to the present invention, the insertion tool for a tangless spiral coil insert is simple in structure and is also easy to manufacture or assemble as compared with a conventional tool. Accordingly, the insertion tool for a tangless spiral coil insert of the present invention can be reduced in manufacturing cost, and besides, is excellent in operability.

BRIEF DESCRIPTION OF THE DRAWINGS

FIG. 1(*a*) is a plane view of a screw shaft to which a pivotal claw is attached in an embodiment of the insertion tool for a tangless spiral coil insert according to the present invention, FIG. 1(*b*) is a central longitudinal sectional view of the screw shaft to which the pivotal claw is attached, FIG. 1(*c*) is a perspective view of a claw section of the pivotal claw, FIG. 1(*d*) is a front view for explaining a state of engagement between a hook section of the claw section and a notch of an end coil section of a spiral coil insert, and FIG. 1(*e*) and FIG. 1(*f*) are front views for explaining states of engagement between an inclined section of the claw section and the notch of the end coil section of the spiral coil insert and disengagement of the both from each other, respectively;

EMBODIMENTS FOR CARRYING OUT THE INVENTION

An insertion tool for a tangless spiral coil insert according to the present invention will be described below in further detail with reference to the drawings.

Embodiment 1

(Overall Tool Configuration)

Figure 2A:
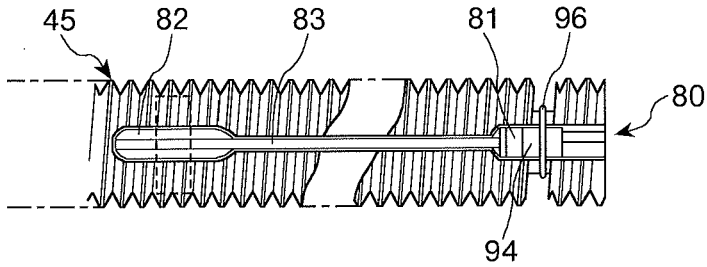
FIG. 2(*a*) is a plan view of a screw shaft to which a pivotal claw is attached in another embodiment of the insertion tool for a tangless spiral coil insert according to the present invention, FIG. 2(*b*) is a central longitudinal sectional view of the screw shaft to which the pivotal claw is attached, FIG. 2(*c*) is a perspective view of a claw section of the pivotal claw, and FIG. 2(*d*) is a front view of an example of a regulation member for regulating a projection amount of the claw section.
Figure 2B:
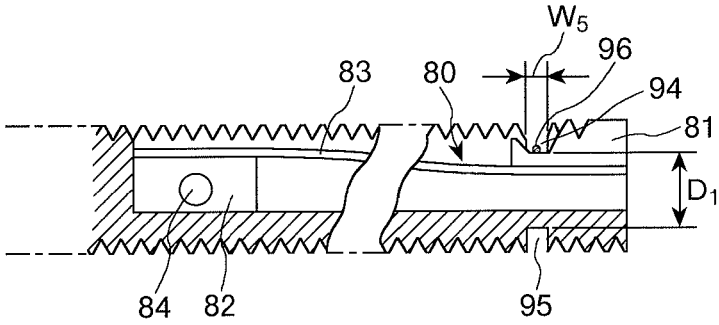
Figure 2C:
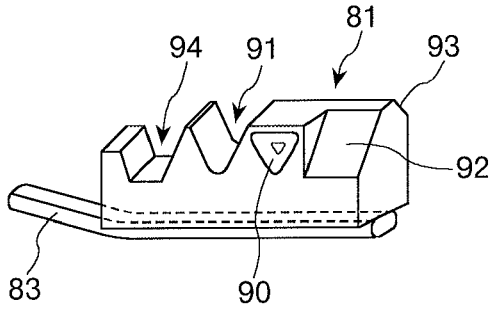
Figure 2D:
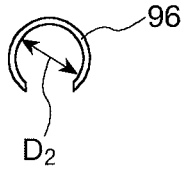
Figure 3:
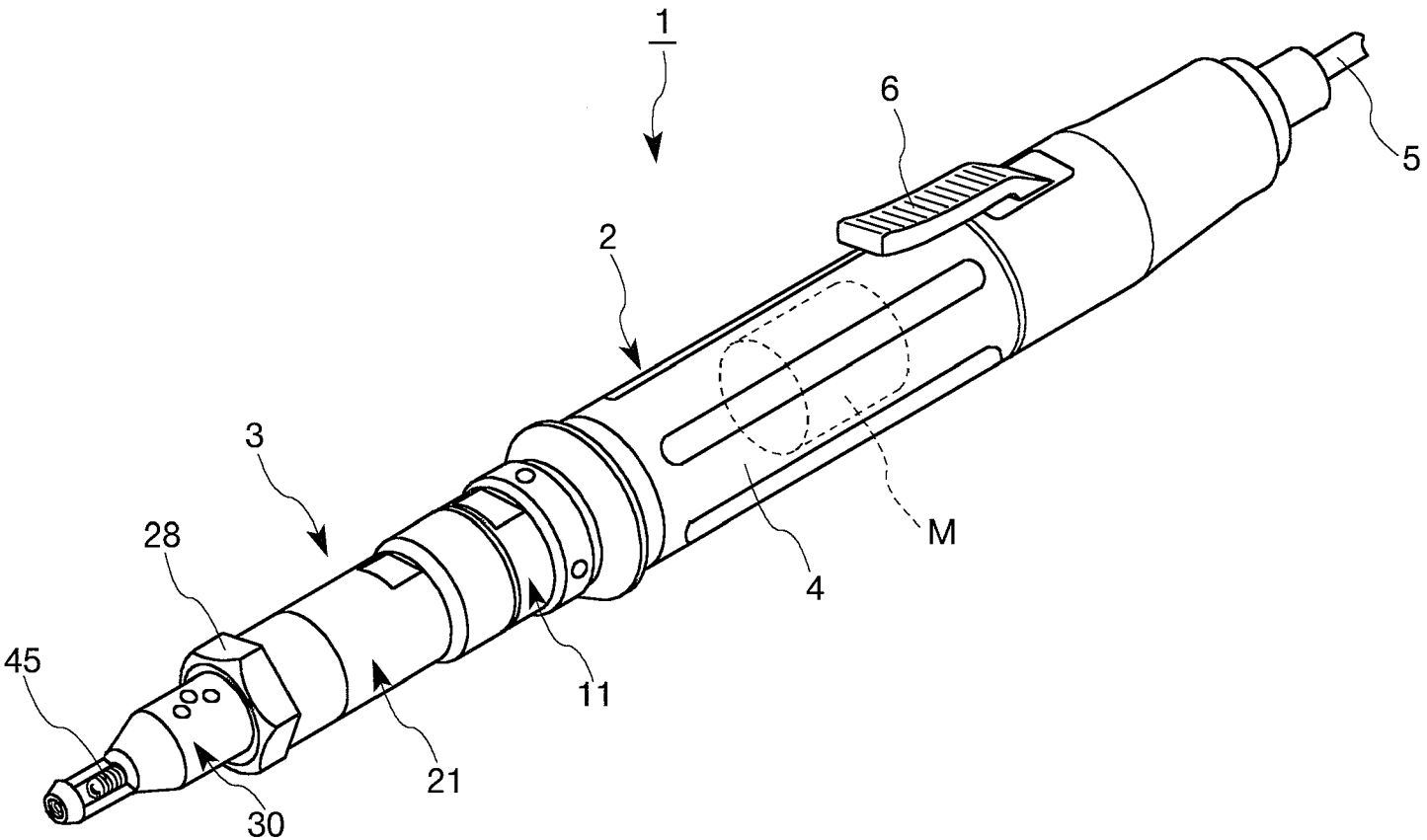
FIG. 3 is a perspective view of an embodiment of the insertion tool for a tangless spiral coil insert according to the present invention.
Figure 4:
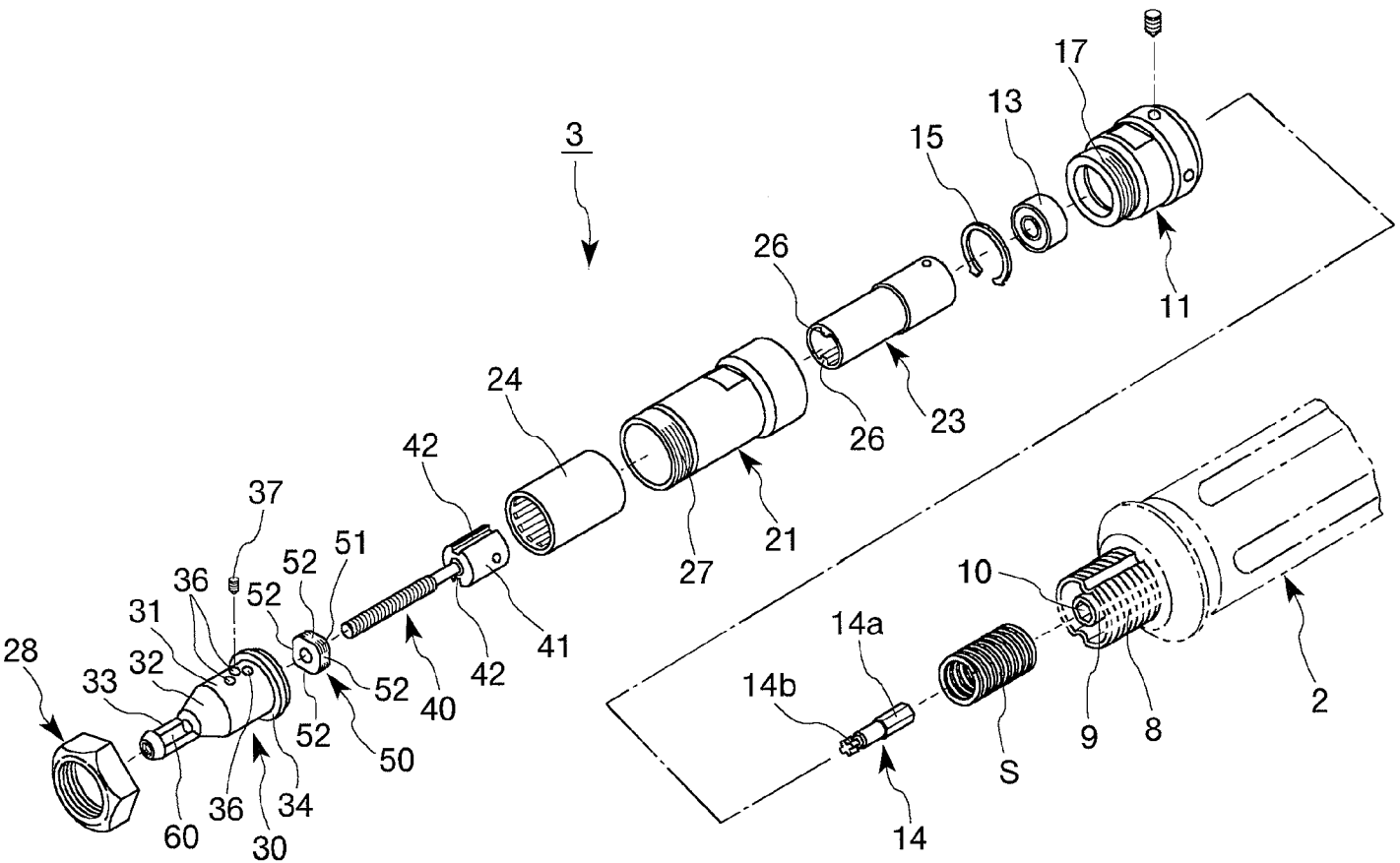
FIG. 4 is an exploded perspective view of the insertion tool for a tangless spiral coil insert according to the present invention shown in FIG. 3.
Figure 5:
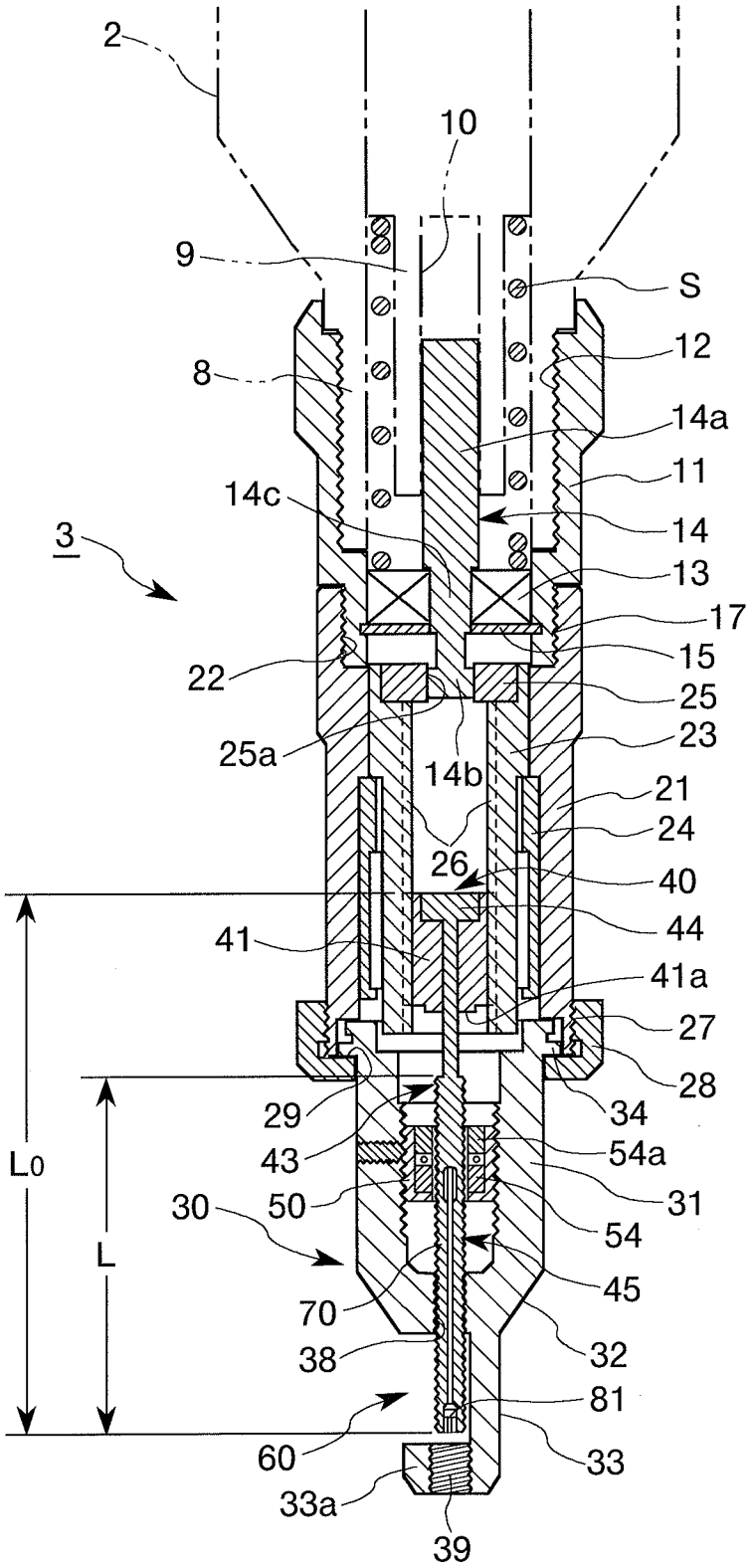
FIG. 5 is a sectional view of the insertion tool for a tangless spiral coil insert according to the present invention shown in FIG. 3.

FIGS. 3 to 5 illustrate one embodiment of an insertion tool 1 for a tangless spiral coil insert in accordance with the present invention. According to the present embodiment, the insertion tool 1 for a tangless spiral coil insert is of an electrically-driven type, and has a drive mechanism section 2 and a coil-insert insertion mechanism section 3.

A casing 4 of the drive mechanism section 2 also serves as a tool grip section, and has a shape that enables an operator to hold the tool with his/her one hand and work. A reversible electric motor M which configures the drive mechanism section 2 and which can be rotationally driven in a forward direction and a backward direction is installed within the casing, or the tool grip section 4. The reversible electric motor M can be connected to an external power supply apparatus (not shown) by a power supply cord 5. The reversible electric motor M is driven and stopped by an on-off switch 6 provided on the tool grip section 4, and a rotational direction of the electric motor M can be changed manually by a changeover switch (not shown).

As such a drive mechanism section 2, a drive mechanism section for an electric rotating tool, such as an electric screwdriver which is conventionally commercially available and which is widely used, can be used, and, since it is a well-known apparatus for persons skilled in the art, further detailed description thereof will be omitted. In this embodiment, a handy tapper (manufactured by HIOS Inc., product name: HIOS-SB400C) was used.

Next, the coil-insert insertion mechanism section 3, which is a characterized section of this invention, will be described.

According to this embodiment, the coil-insert insertion mechanism section 3 has a sleeve-like joint cover 11, and a screw groove 12 is formed on an inner peripheral section at one end (upper end in FIG. 5) of the joint cover 11, so that the joint cover 11 is integrally screwed on a connecting screw shaft 8 of the tool grip section 4.

A joint shaft 14 is rotatably attached inside the joint cover 11 via a bearing 13. The bearing 13 is fixed to the joint cover 11 by a C-shaped retaining ring 15 so as not to move in an axial direction. That is, connecting shafts 14*a* and 14*b* polygonal in section are formed on one side (upper side in FIG. 5) and the other side (lower side in FIG. 5) of the joint shaft 14, respectively, and a central region 14*c* of the joint shaft 14 is held by the joint cover 11 via the above bearing 13.

The joint-shaft upper-end connecting shaft 14*a* is fit into a connecting hole 10 which is formed at a center of a drive shaft 9 of the drive mechanism section 2 and which has a shape complementary to the joint-shaft upper-end connecting shaft 14*a*. Therefore, the joint shaft 14 is connected to the drive shaft 9 so as to be movable in the axial direction, and bidirectional rotating drive forces in both directions are transmitted to the joint shaft 14 from the reversible electric motor M provided in the drive mechanism section 2.

A female screw section 22 formed on an inner peripheral face at an end of a sleeve-like housing 21 is screwed onto an male screw section 17 formed at a lower end in FIG. 5 of the joint cover 11. Thereby, the joint cover 11 and the housing 21 are aligned with and integrally connected with each other in the axial direction.

A sleeve-like drive guide 23 is rotatably held inside the housing 21 via a bearing 24. A connecting boss 25 is integrally provided on an inner peripheral section of the drive guide 23 at an end (upper end in FIG. 5) thereof. A connecting hole 25*a* with a complementary shape which is fitted with the lower-end connecting shaft 14*b* of the joint shaft 14 is formed at a center section of the connecting boss 25, and the joint-shaft lower-end connecting shaft 14*b* is fit into this connecting hole 25*a* and connected thereto so as to be movable in the axial direction, and transmits the rotating drive force to the drive guide 23.

Projections 26 are formed on the inner peripheral section of the drive guide 23 along the axial direction in a region below the connecting boss section 25 so as to project in a radial direction. In this embodiment, two projections 26 are formed opposite to each other in a diametrical direction, but this does not mean a limitation, and three or more projections 26 may be formed.

A screw groove 27 is formed on an outer periphery of the other end (lower end in FIG. 5) of the housing 21, so that a prewinder 30 is aligned with the housing 21 on the same axial line and attached thereto by using a body cap 28 that is screwed onto this screw groove 27.

That is, the prewinder 30 has a large-diameter section 31 formed with a flange 34 at one end (upper end in FIG. 5) thereof and a small-diameter section 33 formed so as to be integrated with the large-diameter section 31 via an inclined connecting section 32.

This prewinder 30 is fixed to the housing 21 by causing a holding face 29 of the body cap 28 to hold the flange 34 and bringing the prewinder 30 into pressure contact with a lower end face of the housing 21.

Further, a mandrel assembly 40 configuring a characterized section of the present invention is disposed in the prewinder 30 so as to penetrate the same in the axial direction.

Figure 6:
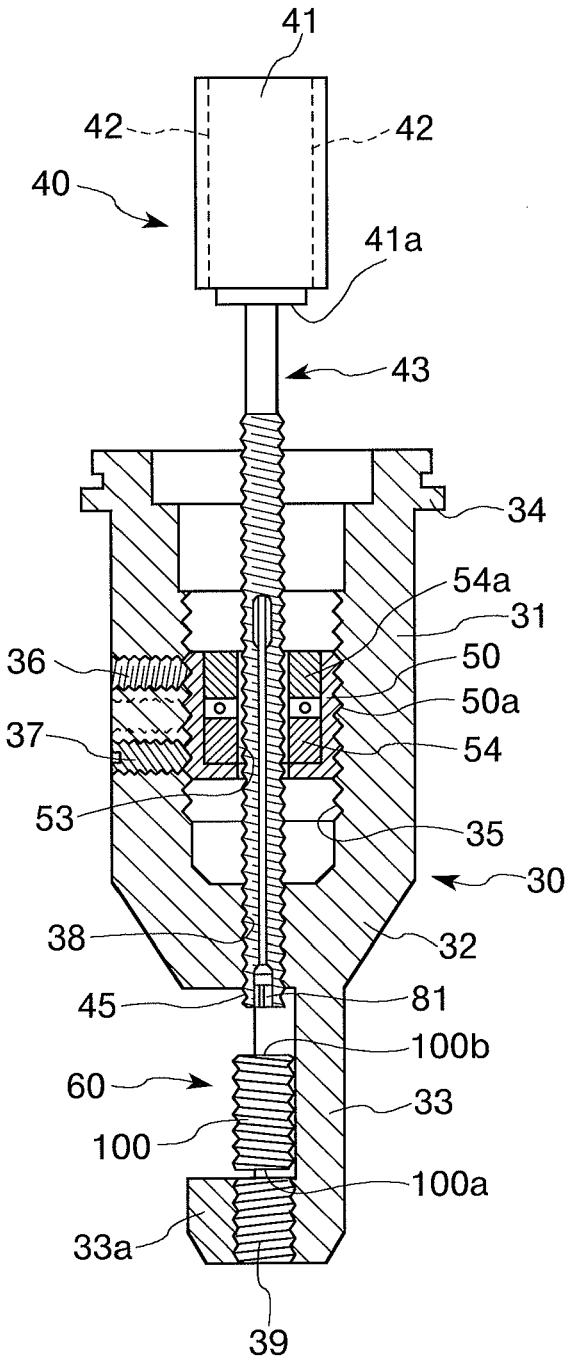
FIG. 6 is a sectional view of a prewinder for explaining motion and operation of the insertion tool for a tangless spiral coil insert according to the present invention shown in FIG. 3.

As explained also with reference to FIG. 6, the mandrel assembly 40 has a drive boss 41 at one end (upper end in FIG. 5 and FIG. 6) thereof. Grooves 42 are formed on an outer peripheral face of the drive boss 41 along the axial direction (FIG. 4, FIG. 6), and slidably fitted on the projections 26 formed on a lower-end inner peripheral section of the drive guide 23. Therefore, the drive guide 23 is rotated so that the rotary drive force thereof is transmitted to the drive boss 41.

A mandrel 43 is integrally disposed at a central section of the drive boss 41. In this embodiment, an attachment boss 44 formed at an upper end of the mandrel 43 is attached to an inner peripheral section of the drive boss 41 by a setscrew or the like. A lower end of the mandrel 43 further extends beyond the drive boss 41 downward to form a screw shaft 45. The mandrel assembly 40 will be described later in detail.

Now, the structure of the prewinder 30 will be described mainly with reference to FIG. 6.

A female screw section 35 is formed on an inner peripheral section of the large-diameter section of the prewinder 30 and is screwed with an outer-peripheral screw section 50*a* of a length adjusting nut 50. In this embodiment, as is understood also by reference to FIG. 4, the outer-peripheral screw section 50*a* of the length adjusting nut 50 is formed to have flat faces 52 in four directions by cutting an outer periphery of a screw section 51 in four directions.

On the other hand, in this embodiment, screw holes 36 are formed on the large-diameter section 31 of the prewinder 30 at three different locations in an axial direction of the prewinder 30. Therefore, the length adjusting nut 50 screwed in the female screw section 35 of the prewinder 30 can be fixed at a desired position in the axial direction of the prewinder 30 by a setscrew 37 screwed in any one of the screw holes 36 at three locations.

Thus, according to the insertion tool of this embodiment, a insertion depth position of the tangless spiral coil insert 100 into a work can be set, as described later in detail, simply by adjusting the length adjusting nut 50 within the prewinder 30 an fixing the same there by the setscrew 37, which is extremely excellent in workability.

Preferably, a thrust bearing 54 is disposed on an inner peripheral section of the length adjusting nut 50. At least an upper race 54*a* of the thrust bearing 54 is rotatable to the length adjusting nut 50. Further, the mandrel screw shaft 45 is disposed so as to pass through a central hole 53 of the thrust bearing 54 in the axial direction.

A female screw section 38 is formed at a central section of the inclined connecting section 32 of the prewinder 30 and it is screwed with the screw shaft 45 of the mandrel 43.

Further, a spiral groove 39 is formed at a leading end 33*a* of the small-diameter section 33 of the prewinder 30 at a central section thereof on the same axial line as the above female screw section 38 and the screw shaft 45. The spiral groove 39 can be screwed onto an outer-peripheral screw section of the tangless spiral coil insert 100, as described later in detail Further, an opening section 60 is formed between the inclined section 32 and the leading end 33*a* of the small-diameter section at which the spiral groove 39 has been formed. As described later in detail, the opening section 60 is set to have a shape and a size that allow attachment of the spiral coil insert 100. Thus, when the spiral coil insert 100 is screwed into a taphole of a work, it is attached to the opening section 60, so that it is inserted into the taphole by the mandrel screw shaft 45.

In the above configuration, when the mandrel assembly 40 is driven by the drive guide 23, the screw shaft 45 of the mandrel 43 is screwed into the screw hole 38 of the prewinder 30, so that the mandrel 43 moves in a predetermined direction in an axial direction according to a rotational direction of the mandrel 43. By reversing the rotational direction of the mandrel 43, the mandrel 43 moves in the other axial direction opposite to the last one.

In FIG. 5 and FIG. 6, when the mandrel 43 moves downward on the figures, an end face of the drive boss 41, or a lower end face 41*a* abuts on the upper race 54*a* of the thrust bearing 54 of the length adjusting nut 50 so that further downward movement is prevented. Therefore, the rotation of the mandrel 43 is forcibly stopped. Accordingly, the transmission of the drive from the drive shaft 9 of the drive mechanism section 2 to the joint shaft 14 is stopped. The magnitude of torque at this time is adjusted by adjusting the amount of compression of a spring S when the joint cover 11 is attached to the screw shaft 8.

Such a configuration can be adopted that a torque sensor is provided in the drive mechanism section 2 and when a predetermined or more magnitude of torque is applied to the drive shaft 9, that is, when rotation stop of the mandrel 43 is detected, the electric motor M is automatically reversed.

(Mandrel Assembly)

Next, the mandrel assembly 40 that configures a characterized section of this invention, in particular, the screw shaft 45 formed integrally in the mandrel 43 will be described with reference to FIGS. 1(*a*), 1(*b*), and 1(*c*).

As described above with reference to FIG. 3 to FIG. 5, the mandrel assembly 40 is provided with the mandrel 43, and the screw shaft 45 extending beyond the drive boss 41 further downward is formed at least at a lower end of the mandrel 43 on the figures.

FIGS. 1(*a*) and 1(*b*) illustrate a lower leading end section of the screw shaft 45 on the side opposite to the drive boss 41, FIGS. 1(*a*) and 1(*b*) illustrate a state where the screw shaft 45 has been disposed horizontally, FIG. 1(*a*) is a plan view, and FIG. 1(*b*) is a center longitudinal sectional view.

The mandrel 43 is formed with the screw shaft 45 where a male screw 70 which can be screwed in an inner-diameter screw section (female screw) of the tangless spiral coil insert 100, over a predetermined length L from a lower leading end on the side opposite to the drive boss 41 in FIG. 5, namely, a right side end in FIG. 1 has been formed. In the mandrel 43, or in a region of the screw shaft 45 in this embodiment, a pivotal claw 80 is attached along an axial direction of the screw shaft 45, in a conventional manner.

In this embodiment, as shown in FIG. 5, a pivotal-claw attachment groove 71 having a depth H1 toward the center of the screw shaft 45 and a width W1 is formed in the axial direction of the screw shaft 45 having the length L over a predetermined length L1 from the right end section in FIG. 1. The right end on the figure of the pivotal-claw attachment groove 71 of the screw shaft 45 is opened in an end face of the screw shaft 45. Further, both end regions 72 and 73 of the pivotal-claw attachment groove 71 are formed to have a wide width, where the right groove section 72 is set to length L2 and width W2, while the left groove section 73 is set to length L3 and width W3.

As specific dimensions for reference, in this embodiment, setting has been made such that an entire length L0 of the mandrel 43=85 mm, an outer diameter D of the screw shaft 45=4.9 mm, L=65 mm, L1=45 mm, L2=5.5 mm, L3=5 mm, and W2=W3=1.45 mm.

In this embodiment, as is understood also with reference to FIG. 1(*c*), the pivotal claw 80 is provided with a claw section 81 formed with a hook section 90 which engages with the notch 101 of the tangless spiral coil insert 100, an attachment section 82 for attaching the pivotal claw 80 to the screw shaft 45, and an elastic connection member 83 which connects the claw section 81 and the attachment section 82 with each other. The elastic connection member 83 is composed of a wire body with elasticity, and, as described above, one end 83*a* thereof is attached to the pivotal-claw attachment groove 71, while the other end 83*b* is fixed to the claw section 81, and the elastic connection member 83 biases the claw section 81 outward in a radial direction of the screw shaft 45 so that the claw section 81 elastically engages with the notch 101 of the coil insert 100.

The claw section 81 is an approximately-rectangular plate member having predetermined shape dimensions which adapt to the above right wide groove section 72 and which allow the claw section 81 to move smoothly in the radial direction of the screw shaft 45 in the groove section 72, that is, a length L11, a thickness T11, and a width W11. Further, the attachment section 82 is also an approximately-rectangular plate member having predetermined shape dimensions which allow the attachment section 82 to be disposed in the wide-width groove section 73, that is, a length L12, a thickness T12, and a width W12. The attachment section 82 is fixed to the screw shaft 45 by a mounting pin 84 press-fitted and set so as to penetrate the screw shaft 45.

As specific dimensions for reference, in this embodiment, setting has been made such that L11=5 mm, T11=2 mm, and W11=1.3 mm, and further, L12=4.8 mm, T12=2.4 mm, and W12=1.3 mm.

In this embodiment, as shown in FIG. 1(*c*), the elastic connection member 83 of the wire body that connects the claw section 81 and the attachment section 82 with each other is an elliptical deformed wire obtained by subjecting both upper and lower faces of a piano wire with a diameter d to abrasive cutting. In this embodiment, as shown in FIG. 1(*b*), this deformed wire 83 is attached such that one end 83*a* thereof is fixed to an upper face of the attachment section 82, and the other end 83*b* thereof is fixed to a lower face of the claw section 81. The deformed wire 83 can be fixed to the attachment section 82 and the claw section 81, for example, by welding or the like.

By adopting such a configuration, the claw section 81 can be moved downward about an attachment position thereof to the attachment section 82 which is a swinging center. Though the claw section 81 will be described later in detail, an upper face of the claw section 81 is set so as to be approximately equal to an outer diameter of the screw shaft 45 or to project slightly in the radial direction. Therefore, the claw section 81 can be pushed into the attachment groove section 71 against a biasing force of the elastic connection member 83 by pushing the upper face thereof toward the center of the screw shaft 45.

Next, with reference to FIG. 1(*c*), the claw section 81 will be described. FIG. 1(*c*) illustrates one embodiment of the claw section 81 used in this embodiment.

In this embodiment, the hook section 90 which elastically engages with the notch 101 of an end coil section 100*a* of the coil insert 100, as shown in FIG. 1(*d*), when the claw section 81 is rotated with the screw shaft 45 to be screwed into the tangless spiral coil insert 100, is formed on one face of the claw section 81, or on a face on the near side thereof in FIG. 1(*c*). This hook section 90 can be formed in a triangular-pyramidal (diamond-like) shape substantially identical with a contact section of the notch 101 of the end coil section 100*a* (100*b*) (see FIG. 6) of the coil insert 100. A depth E of a recess of this hook section 90 is set such that the notch 101 of the coil insert 100 is maintained in the recess 90 during attaching working, as shown in FIG. 1(*c*), so that the notch 101 is kept in contact with a recessed face of the recess.

Further, a notch 91 in the shape of the screw groove of the screw shaft 45 is formed at a location adjacent to the hook section 90, or to be positioned on the left side (backward at a screwing time to the coil insert) of the hook section 90 in FIG. 1(*c*). This notch 91 is for catching a thread ridge next to a leading thread ridge of the coil insert 100 engaged by the hook section 90, when the screw shaft 45 has been screwed into the coil insert 100, so that, when an axial force toward a rear of the coil insert 100 acts on the notch 101 of the coil insert 100, the coil insert 100 is prevented from slipping out of the hook section 90 to release a state of engagement between the hook section 90 and the notch 101 of the coil insert 100.

Incidentally, in this embodiment, as shown in FIG. 2(*c*), leading inclined sections 92 and 93 are formed to be positioned on the right side of the hook section 90 (a leading section at a screwing time to the coil insert 100). These inclined sections 92 and 93 serve a guide function of, when the screw shaft 45 is screwed into the coil insert 100, pressing the claw section 81 which has been protruded slightly from an outer periphery of the screw shaft inward into the groove section 72 at a terminal coil section 100*b* (see FIG. 6) of the coil insert 100 screwed along a terminal screw groove of the screw shaft 45 against a biasing force exerted by the elastic connection member 83 so that the coil insert 100 is smoothly screwed onto the screw shaft 45, as shown in FIG. 1(*f*). Further, when the screw shaft 45 is removed from the coil insert 100 after the coil insert 100 is attached to a work, these inclined sections 92 and 93 serve a guide function of making it easy to remove the screw shaft 45 smoothly from the coil insert 100 by downward pressing of the claw section 81 performed by the terminal coil section 100*b* which the notch of the coil insert 100 has been formed, as shown in FIG. 1(*e*).

The shape of the claw section 81 is not limited to one having the structure shown in the above embodiment described with reference to FIG. 1(*c*), and persons skilled in the art could arrive at other various modified embodiments, for example, such as described in the patent literature 1.

Next, with reference to FIGS. 2(*a*), 2(*b*), and 2(*c*), another modified embodiment of the screw shaft 45 of the mandrel will be shown.

Modified Embodiment 1

In the above embodiment, the position of the claw section 81 has been determined according to the shape of the elastic connection member 83. Therefore, if there are variations in accuracy of assembling or manufacture of a part, it is thought that the claw section 81 is not always set at a designed location.

Then, in this modified embodiment 1, a position regulating member 96 for the claw section 81 is provided. Since the other configurations are the same as the configurations in the above embodiment, members serving identical function and effect are denoted by identical reference numerals to incorporate the description in the above embodiment hereinbelow.

That is, in this modified embodiment 1, as shown in FIGS. 2(*a*), 2(*b*), and 2(*c*), in the claw section 81 of the pivotal claw 80, a second notch 94 is formed so as to be disposed adjacent to the notch 91, on the left side of the notch in FIG. 2(*c*) (rearward at a screwing time to the coil insert 100). An annular groove 95 having a width W5 and a groove-bottom diameter D1 is formed on the screw shaft 45 in a circumferential direction thereof so as to coincide with the notch 94, and a stopper ring 96 that is a C-shaped retaining ring serving as a position regulating member 96 is attached around an outer periphery of the annular groove 95. In this embodiment, D2=D1=2.8 mm is set. The stopper ring 96 is, for example, a ring having an inner diameter D2 (identical with the annular groove diameter D1) made of a piano wire having a diameter of 0.5 mm. Further, in this modified embodiment, strength of the elastic connection member 83 is set so as to cause the claw section 81 of the pivotal claw 80 to project outside in the radial direction by a predetermined distance from the outer peripheral face of the screw shaft 45. That is, the amount of radial outward movement of the claw section 81 due to the biasing force of the elastic connection member 83 is regulated by the stopper ring 96.

Therefore, according to this modified embodiment, since a projection amount (movement amount) of the claw section 81 of the pivotal claw 80 in the direction of the outer periphery of the screw shaft (outside in the radial direction) is set constant by the regulating member (stopper ring) 96, assembling or manufacturing becomes easier, and further, the tool also becomes excellent in operability.

(Motion Aspect and Operation Method of the Tool)

Next, particularly, with reference to FIG. 6 to FIG. 8, a motion aspect and an operational method of the insertion tool 1 for a spiral coil insert of this invention thus configured will be described.

The electric motor M of the drive mechanism section 2 is activated by operating the on-off switch 6 and/or the rotational-direction change-over switch, and, as shown in FIG. 6, is stopped with the mandrel 45 pulled up in FIG. 6.

In this state, the tangless spiral coil insert 100 is charged into a space formed at the position of the opening section 60 of the prewinder 30. In this embodiment, since the spiral groove 39 is formed inside the lower leading end section 33*a* of the prewinder 30, such a configuration can prevent the coil insert 100 charged in the opening section 60 via a lower leading end through-hole from falling through the leading end through-hole of the prewinder 30, which is preferred.

Next, the electric motor M of the drive mechanism section 2 is activated by operating the switch, and rotated in a direction opposite to the last rotational direction to move the mandrel 45 downward. Thereby the mandrel screw shaft 45 is screwed into an inner-circumferential screw section of the coil insert 100, and the hook section 90 of the claw section 81 disposed at a leading end of the mandrel screw shaft 45 engages with the notch 101 of the leading end coil section 100*a* of the spiral coil insert 100 (see FIG. 1(*d*)).

Figure 7:
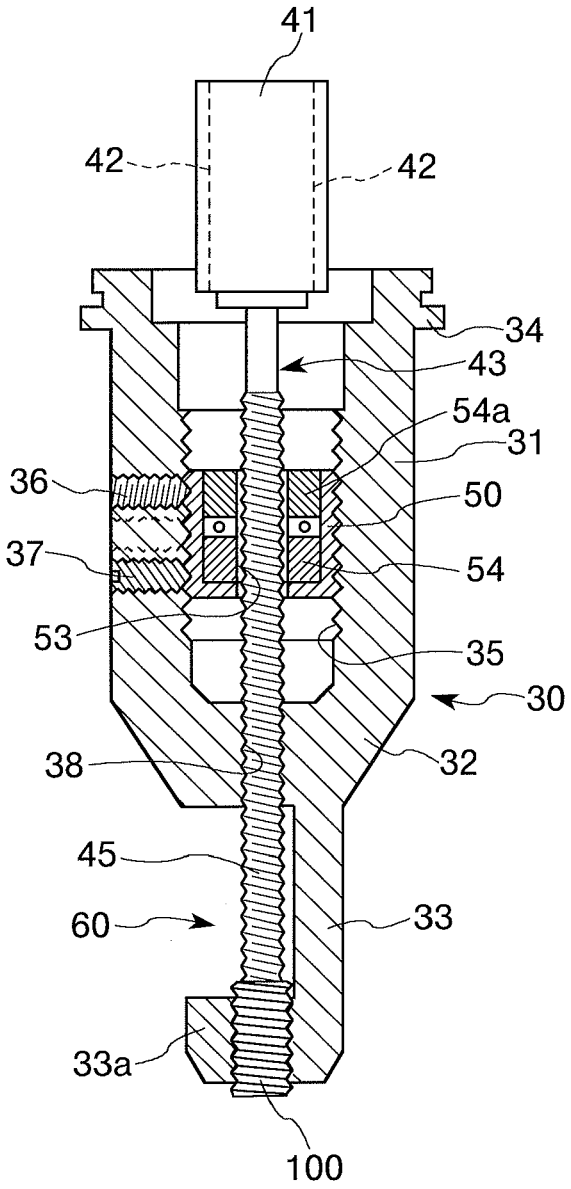
FIG. 7 is a sectional view of a prewinder for explaining motion and operation of the insertion tool for a tangless spiral coil insert according to the present invention shown in FIG. 3.
Figure 8:
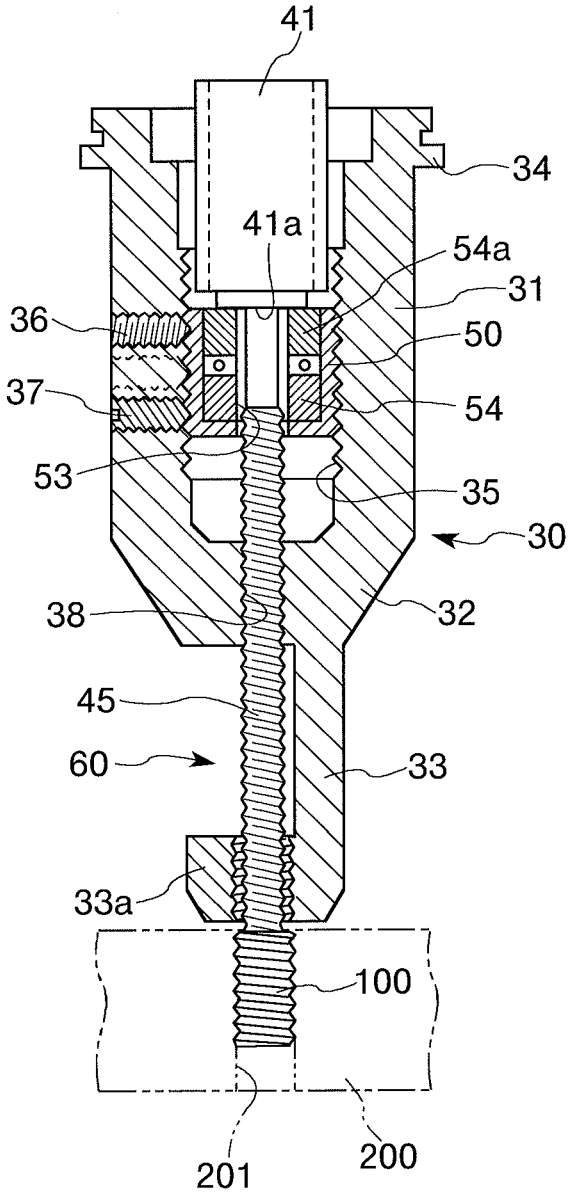
FIG. 8 is a sectional view of a prewinder for explaining motion and operation of the insertion tool for a tangless spiral coil insert according to the present invention shown in FIG. 3.

When the rotation of the electric motor M is further continued in this state, the spiral coil insert 100 is rotationally driven by the mandrel screw shaft 45, so that it is screwed into the spiral groove 39 in the lower leading end section of the prewinder 30, as shown in FIG. 7, and the spiral coil insert 100 is further screwed into a taphole 201 of a work 200 by rotation of the mandrel 45, as shown in FIG. 8.

As described above, the mandrel 45 moves downward, and the lower end face 41*a* of the drive boss 41 abuts onto the upper race 54*a* of the thrust bearing of the length adjusting nut 50, so that rotation of the mandrel 45 is stopped. That is, the drive transmission from the drive mechanism section 2 to the joint shaft 14, the drive guide 23, and the drive boss section 41 is stopped, and the spiral coil insert 100 is screwed to a predetermined position in the taphole 201 of the work 200.

At this time, the electric motor M automatically rotates in reverse, applies rotation in a reverse direction to the mandrel 45 so that the mandrel 45 is released from the spiral coil insert 100.

According to this embodiment, as described above, since the length adjusting nut 50 is provided with the thrust bearing 54 so that a good thrust-bearing relationship can be established between the end face 41*a* of the drive boss 41 and the length adjusting nut 50, the spiral coil insert 100 can be inserted and installed at a predetermined depth position in the work 200 with high accuracy and with good workability.

Embodiment 2

In the above embodiment, this invention has been described as the electric insertion tool for a tangless spiral coil insert, but this invention can be applied similarly to a manual insertion tool for a tangless spiral coil insert.

Figure 9:
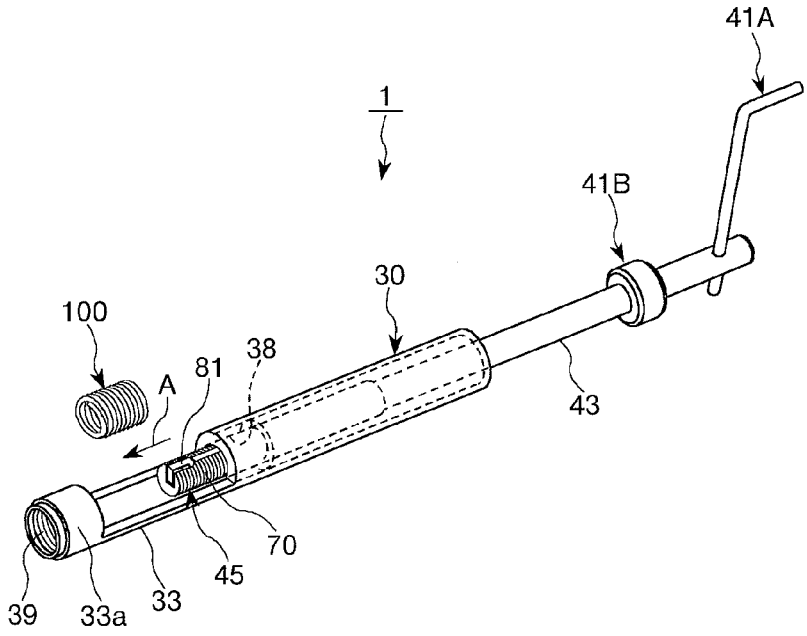
FIG. 9 is a perspective view of another embodiment of the insertion tool for a tangless spiral coil insert according to the present invention.
Figure 10:
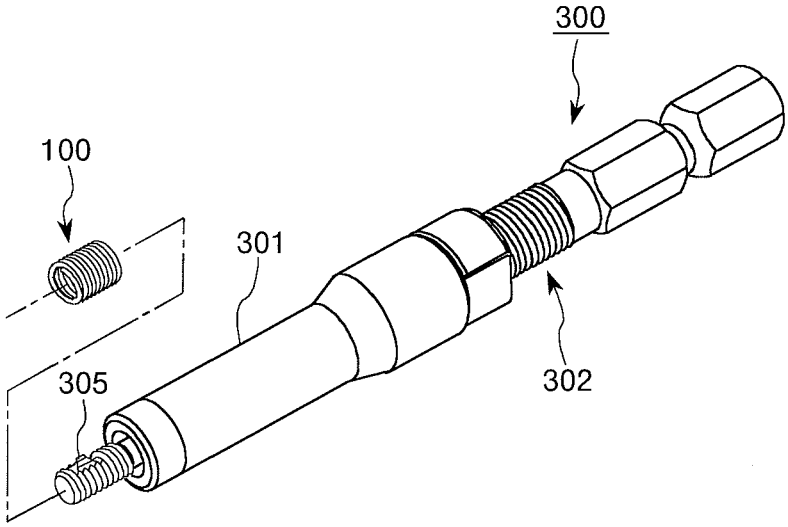
FIG. 10 is a perspective view showing one example of a conventional insertion tool for a tangless spiral coil insert.
Figure 11:
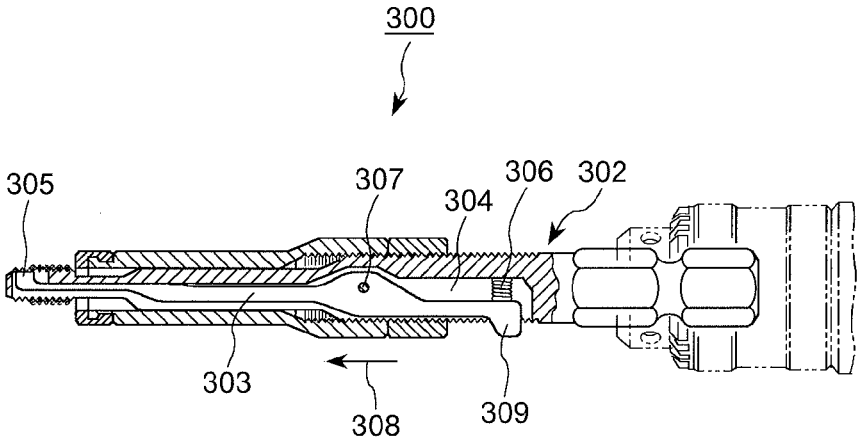
FIG. 11 is a sectional view of the conventional insertion tool for a tangless spiral coil insert shown in FIG. 10.
Figure 12:
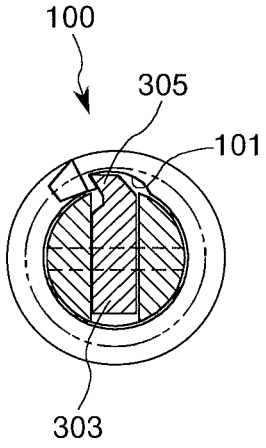
FIG. 12 is a front view for explaining a state of engagement between a hook section of a claw section of an insertion tool for a tangless spiral coil insert and a notch of an end coil section of a spiral coil insert.

In FIG. 9, one embodiment of a manual insertion tool 1 for a tangless spiral coil insert of this invention will be described. The manual insertion tool 1 for a tangless spiral coil insert of this embodiment is similar to such a configuration that the mandrel assembly 40 has been assembled in the prewinder 30 as described in the embodiment 1 and shown in FIG. 6 and the like. However, such a configuration is adopted that a cylindrical casing of the prewinder 30 is formed to have a shape slightly extended in an axial direction so as to be suitable for gasping and a drive handle 41A is provided on the mandrel 43 in place of the drive boss 41 driven by the drive motor M, so that the mandrel 43 is rotationally driven manually.

By rotating the mandrel 43 with the drive handle 41A, the screw shaft 45 formed integrally in the mandrel 43 is screwed to the female screw section 38 formed inside the casing of the prewinder 30 to be moved in a direction of an arrow A.

The other configurations can be made identical with the configurations described in the embodiment 1 or the modified embodiment 1. Further, since the drive boss 41 is eliminated, an adjusting ring 41B is adjustably provided on the mandrel 43 in the axial direction. Therefore, in this embodiment, the adjusting nut 50 shown in FIG. 6 is eliminated. An entire configuration of the manual insertion tool for a spiral coil insert, except for the characterized sections of this invention, is well-known to persons skilled in the art. Further, various modified configurations are known.

Therefore, members having identical function and effect with the members in the above embodiment 1 or modified embodiment 1 is denoted by an identical reference number to incorporate the description in the above embodiment 1 or modified embodiment 1 herein, so that further detailed description is omitted.

DESCRIPTION OF REFERENCE NUMERALS

1 Insertion tool for a spiral coil insert
2 Drive mechanism section
3 Coil-insert insertion mechanism section
4 Casing (Tool grip section)
5 Power cord
6 On-off switch
8 Connecting screw shaft
9 Drive shaft
30 Prewinder
38 Screw hole
40 Mandrel assembly
41 Drive boss
43 Mandrel
45 Mandrel screw shaft

71 Pivotal-claw attachment groove
80 Pivotal claw
81 Claw section
82 Attachment section
83 Elastic connection member
90 Hook section
96 Stopper ring (Positional regulation member)

The invention claimed is:

1. An insertion tool for a tangless spiral coil insert, comprising:

a mandrel defining a longitudinal axis, at least a leading end section of the mandrel including a screw shaft, a pivotal claw and a pivotal-claw attachment groove;

the pivotal claw including a claw section, an attachment section fixed to the screw shaft and an elastic connection member connecting the claw section to the attachment section;

the pivotal-claw attachment groove extending along the longitudinal axis for a predetermined length, the pivotal-claw attachment groove including a proximal end and an opposing distal end, the distal end receiving at least a portion of the claw section therein; and the elastic connection member being at least partially positioned within the pivotal-claw attachment groove and extending from the proximal end to the distal end of the pivotal-claw attachment groove, a first end of the elastic connection member being fixed to the attachment section of the pivotal claw, an opposing second end of the elastic connection member being attached to the claw section of the pivotal claw, the elastic connection member biasing the claw section outwardly in a radial direction of the screw shaft such that a hook section formed on the claw section elastically engages with a notch of the tangless spiral coil insert.

2. An insertion tool for a tangless spiral coil insert according to claim 1, wherein the elastic connection member is a wire body having elasticity.

3. An insertion tool for a tangless spiral coil insert according to claim 1, further comprising:

a regulation member regulating an amount of movement of the claw section biased by the elastic connection member in a radially outward direction of the screw shaft.

4. An insertion tool for a tangless spiral coil insert according to claim 3, wherein the regulation member is a stopper ring, and is attached on an outer periphery of the screw shaft adjacent to the hook section of the claw section.

* * * * *